US007823557B2

(12) United States Patent
Hunter et al.

(10) Patent No.: US 7,823,557 B2
(45) Date of Patent: Nov. 2, 2010

(54) COMPRESSION IGNITION ENGINE HAVING FUEL INJECTION DEVICES AND PROCESSES FOR PROMOTING CLEANER BURNING LIFTED FLAME COMBUSTION

(75) Inventors: Gary L. Hunter, Elburn, IL (US); Kresimir Gebert, Villa Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 851 days.

(21) Appl. No.: 11/736,886

(22) Filed: Apr. 18, 2007

(65) Prior Publication Data

US 2008/0257302 A1 Oct. 23, 2008

(51) Int. Cl.
*F02B 17/00* (2006.01)

(52) U.S. Cl. ..... 123/298

(58) Field of Classification Search ..... 123/298, 123/297, 295; 239/585.1, 553.3, 553.5
See application file for complete search history.

(56) References Cited

U.S. PATENT DOCUMENTS 7,131,423 B2 * 11/2006 Ehresman ..... 123/297
7,134,615 B2 * 11/2006 Lawrence ..... 239/533.3
7,578,279 B2 * 8/2009 Ehresman ..... 123/297

* cited by examiner

*Primary Examiner*—Hieu T Vo
(74) *Attorney, Agent, or Firm*—Jack D. Nimz; Jeffrey P. Calfa

(57) ABSTRACT

A mixing and combustion process for a compression ignition engine (10) creates an in-cylinder compressed gas charge of air and recirculated exhaust that has a temperature high enough to initiate and sustain combustion of diesel fuel that is subsequently injected. A fuel injector (26) injects diesel fuel directly into the charge using an injection pressure that is sufficiently great to cause fuel to be injected through each of multiple orifices arranged in a geometric pattern in a nozzle (42) of the fuel injector at an initial velocity that is great enough to cause the injected fuel in moving through the compressed gas charge to creates fuel/charge mixtures throughout a substantial portion of the respective combustion chamber before the kinematics of combustion can become effective to combust more than at most a relatively small amount of the injected fuel.

1 Claim, 2 Drawing Sheets

COMPRESSION IGNITION ENGINE HAVING FUEL INJECTION DEVICES AND PROCESSES FOR PROMOTING CLEANER BURNING LIFTED FLAME COMBUSTION

FIELD OF THE INVENTION

This invention relates generally to internal combustion engines having combustion chambers into which fuel is injected and to devices and methods for fuel injection. More particularly, the invention relates to the direct injection of fuel into engine cylinders under intense injection pressure through multiple tiny orifices in the injector nozzles to create high velocity jets that are capable of mixing with compressed charge air and recirculated exhaust gas in a manner that results in the creation of distributed air/fuel mixtures throughout a substantial portion of the compressed gas volume in the effective combustion chamber space at incipiency of an in-cylinder combustion event substantially at engine top dead center so that ensuing combustion proceeds with the in-cylinder mixture being a more homogeneous one than that attainable by conventional diesel combustion processes. The invention may be considered to provide in-cylinder lifted flame combustion because the inventive process creates widely distributed combustible mixtures at significant distances from the orifices through which the fuel that created them is injected so that the ensuing combustion of those mixtures occurs throughout the effective combustion chamber space volume.

BACKGROUND OF THE INVENTION

Factors relevant to control of fueling of a compression ignition (diesel) engine include the timing of an injection of fuel into a combustion chamber, the duration of the fuel injection, and the pressure at which the fuel is injected. The physical construction of various devices in the fueling system, such as the fuel injectors, and combustion chamber geometry are also relevant factors.

A known electronic engine control system comprises a processor-based engine controller that processes data from various sources to develop control data for controlling certain functions of the engine, including fueling of the engine by injection of fuel into engine combustion chambers. A known diesel engine that powers a motor vehicle has an oil pump that delivers oil under pressure to an oil rail serving electric-actuated fuel injection devices, or simply fuel injectors, that use oil from the oil rail to force injections of fuel. The pressure at the oil rail is sometimes referred to as injection control pressure, or ICP, and that pressure is under the control of an appropriate ICP control strategy that is an element of the overall engine control strategy implemented in the engine control system.

Certain known fuel injectors contain electric-actuated valves that control the delivery of oil that has been pumped to an oil rail at ICP to pistons that force fuel into the engine combustion chambers via plungers. Certain fuel injectors are capable of pressure amplification that can develop very high injection pressures. Moreover, certain fuel injectors have the capability to digitally modulate pressure during an injection (sometimes referred to as rate-of-injection, or ROI, shaping).

The on-going development of engine combustion technology is striving to improve the quality of combustion processes so that lesser amounts of undesired constituents are present in engine exhaust. In order to attain compliance with standards that may be applicable to tailpipe emissions, even improved in-cylinder combustion processes may still require that exhaust systems include one or more types of exhaust after-treatment devices.

One such after-treatment device is a diesel particulate filter (DPF). A DPF is capable of physically trapping diesel particulate matter (DPM) in exhaust gas passing through the exhaust system from the engine to prevent significant amounts of DPM from entering the atmosphere.

Another after-treatment device is a NOx adsorber catalyst, sometimes called a lean NOx trap, or LNT. It removes significant NOx from exhaust gas.

Such after-treatment devices add cost to an engine and hence to any new automotive vehicle propelled by such an engine. From time to time the after-treatment devices also require regeneration. While some regeneration occurs naturally, the level of trapped products of combustion eventually reaches a point where the after-treatment device requires forced regeneration. Forced regeneration typically involves operating the engine in a way that creates elevated exhaust temperatures. The creation of such temperatures of course requires the combustion of additional fuel which penalizes fuel economy.

Proposed solutions for compliance with tailpipe emission levels defined by current EPA regulations for MY 2010 include the use of wall flow particulate traps and NOx after-treatment devices, such as SCR, LNT, or LNC, and combinations thereof. Other proposed solutions involve the use of homogeneous charge compression ignition (HCCI) with limited Brake Mean Effective Pressure (BMEP) capability, or very high diluent concentrations ($O_2$ concentration<about 14%). Reducing oxygen concentration of an air/fuel mixture, typically by control of recirculated exhaust (EGR), slows kinetics of the combustion process, allowing more time for fuel and charge air to mix before combusting. But implementation of that type of strategy is made at the cost of increasing the complexity of the charge management system and increasing total system heat rejection. BMEP refers to the average pressure that would need to be present in a cylinder to realize the observed brake torque produced by the engine.

SUMMARY OF THE INVENTION

Briefly, the present invention relates to the direct injection of diesel fuel into combustion chambers under intense injection pressure, sometimes referred to here as ultra-high injection pressure, through tiny orifices in a fuel injector nozzle. The nozzle contains a sufficient number of suitably sized and appropriately located orifices to inject fuel as high-velocity jets that mix with compressed charge air and recirculated exhaust gas throughout a substantial portion of the effective combustion chamber space volume of an engine cylinder at a rate sufficiently faster than the kinetics of combustion of the mixture that is being created.

The inventive mixing and combustion process creates distributed air/fuel mixtures throughout a substantial portion of the effective combustion chamber space volume of the engine cylinder substantially at incipiency of the in-cylinder combustion event. Combustion then proceeds throughout a more homogeneous mixture than one that is attained by conventional diesel (CD) combustion processes.

The inventive process is distinguished in various ways from other processes, such as HCCI, that unlike CD combustion inject fuel earlier during a compression upstroke in order to promote better mixing in advance of compression ignition that occurs substantially at top dead center (TDC). The inventive process is more like CD combustion than HCCI combustion in that fuel is injected within a range of a compression upstroke that is closer to TDC than is typically the case for HCCI combustion, a range where in-cylinder gas pressure and temperature are higher.

The inventive mixing and combustion process significantly reduces the rate at which particulate matter is formed as combustion proceeds. Moreover, it requires only enough diluent (EGR) to control NOx to required levels, allowing the oxygen concentration in the mixture to exceed about 14%. The process provides what may be considered as in-cylinder lifted flame combustion because much of the combustion event is characterized by combustion of distributed air/fuel mixtures at locations distant from the orifices through which the fuel forming the mixtures has been injected.

An EGR system similar to those currently in use and/or proposed for use can provide proper control of diluent for appropriate limitation of NOx.

Injection pressure capable of producing an injection velocity in excess of about 575 meters per second (m/s) from each of a suitable number of nozzle orifices arranged in a suitable geometric pattern with respect to the piston/cylinder geometry near TDC, each having a diameter within a range of about 80 microns to about 130 microns, can enable an engine to develop rated and peak torque with an injection duration spanning from about 25 crank angle degrees to about 35 crank angle degrees with start of injection (SOI) within a range from about 10° before top dead center (TDC) to about 15° after TDC. Because a fuel injector that possesses the attributes of very fast injection pressure rise and fall (>20 bar/μs), an injection of fuel may occur as a succession of discrete pulses within a defined range to deliver the appropriate amount of fuel for engine speed and load. An example of this is an injection that comprises three discrete pulses, the first starting in advance of TDC (5° before TDC for example), the second starting after TDC (5° after TDC for example), and the third starting still later (at 15° after TDC for example). The duration of each discrete pulse depends on engine speed and load and the response characteristic of the individual fuel injector. The dwell between the individual pulses is typically optimized with respect to soot, NOx, or BSFC.

A fuel injector that is also capable of ROI shaping may provide additional useful process control capabilities, such as real time control of governing near-nozzle mixing and flame phenomena. The ability to control the rate of injection (ROI) may improve fuel mixing immediately upon leaving an injector orifice by tailoring injected spray velocity to real time demand of the in-cylinder fuel/air mixing process. During spray development, dispersed liquid fuel entrains in the surrounding mixture comprised of fresh air and recirculated exhaust gas. Depending on instantaneous charge macro flow characteristics (velocity of large flow structures and turbulence intensity) as well as the local pressure field in the volume surrounding the spray, it may be desirable to quickly decrease velocity of injected fuel so as to enable flow and the pressure field to change, and perhaps the surrounding spray to be replenished with fresh charge. This so called injection pressure modulation should be accomplished very quickly, say on the order of 20 bar/microsecond, or even faster. As boundary case, pressure modulation may be considered as pulsed injection, in which typical injection interval, say 25 cad is comprised of several quick discrete injection events, separated with controlled dwell time. By optimizing the duration of each dwell, as well as by optimizing duration of each discrete injection pulse, improved fuel/air mixing can be achieved, leading to further combustion processes that avoid the soot and NOx islands, described elsewhere here.

The inventive process is also distinguished by an increased fuel/charge air mixing rate that in effect "outraces" the combustion kinetics, unlike known processes that seek to limit combustion temperatures (i.e. low temperature diesel combustion) by slowing the kinetics to allow for conventional mixing process rates to suffice.

The inventive process uses ultra-high injection pressures to inject jets of fuel through an appropriate number of tiny injector nozzle orifices so as to accelerate the fuel/charge air mixing rate to one that is faster than the rate at which diesel fuel ignites and burns. This serves to reduce the rate at which DPM is created in the combustion chamber. Consequently diluent is needed only in an amount sufficient to control NOx formation, and this represents a significant distinction from the known use of very high EGR rates to slow the chemistry of the soot formation process. Benefits of this reduced diluent requirement are a reduction in the complexity of turbomachinery/charge air management hardware and lower system heat rejection.

Depending on various factors relevant to any particular engine and/or motor vehicle, the inventive process offers the potential for eliminating some or all after-treatment devices that might otherwise be required, or at least the potential to limit the size and complexity of such devices and associated controls. The resulting weight and cost reductions, coupled with performance and durablity improvements, would be of significant benefit to customers, manufacturers, and the environment. Fuel economy penalties may also be reduced.

Accordingly one generic aspect of the invention relates to processes for operating a compression ignition engine.

In one respect, the process comprises, in each of one or more combustion chambers of the engine, creating a compressed gas charge that has a temperature high enough to initiate and sustain combustion of diesel fuel that is subsequently injected into the compressed gas charge. Each of one or more fuel injectors is operated to inject diesel fuel directly into a respective combustion chamber using an injection pressure that is sufficiently great to cause fuel to be injected through each of multiple orifices arranged in a geometric pattern in a nozzle of each such fuel injector into the respective compressed gas charge at an initial velocity that is great enough to cause the injected fuel, in moving through the compressed gas charge, to create fuel/charge mixtures throughout a substantial portion of the respective combustion chamber before the kinematics of combustion can become effective to combust more than at most a relatively small amount of the injected fuel.

In another respect, the process comprises operating each of one or more fuel injectors to inject diesel fuel directly into one or more combustion chambers of the engine using an injection pressure of at least about 3000 bar to inject the fuel through a multitude of orifices arranged in a geometric pattern in a nozzle of each fuel injector. Each orifice has a diameter in a range from about 80 microns to about 130 microns. These parameters cause the fuel to be injected from each orifice into a compressed gas charge in the respective combustion chamber at an initial velocity of at least about 575 meters per second.

In still another respect, the process comprises in each of one or more combustion chambers of the engine creating a compressed gas charge that has a temperature high enough to initiate and sustain combustion of diesel fuel that is subsequently injected into the compressed gas charge. Each of one or more fuel injectors is operated to inject diesel fuel directly into a respective combustion chamber to cause initial combustion to skirt the soot island that is present in a graph of equivalence ratio versus adiabatic mixture flame temperature for diesel fuel combustion and the aggregate of subsequent combustion that constitutes a majority of the total combustion to occur in a zone of the graph separating the soot island from the NOx island. Ideally the majority of the total combustion is 100% of combustion.

Another aspect relates to an engine for performing the described processes.

Still another aspect relates to a fuel injector for injecting diesel fuel into a combustion chamber of a compression ignition engine comprising an intensifier for amplifying ICP to create an injection pressure at a nozzle of the fuel injector at least about 3000 bar, and a multitude of orifices in the nozzle through which fuel is injected, the orifices having diameters within a range from about 80 microns to about 130 microns.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
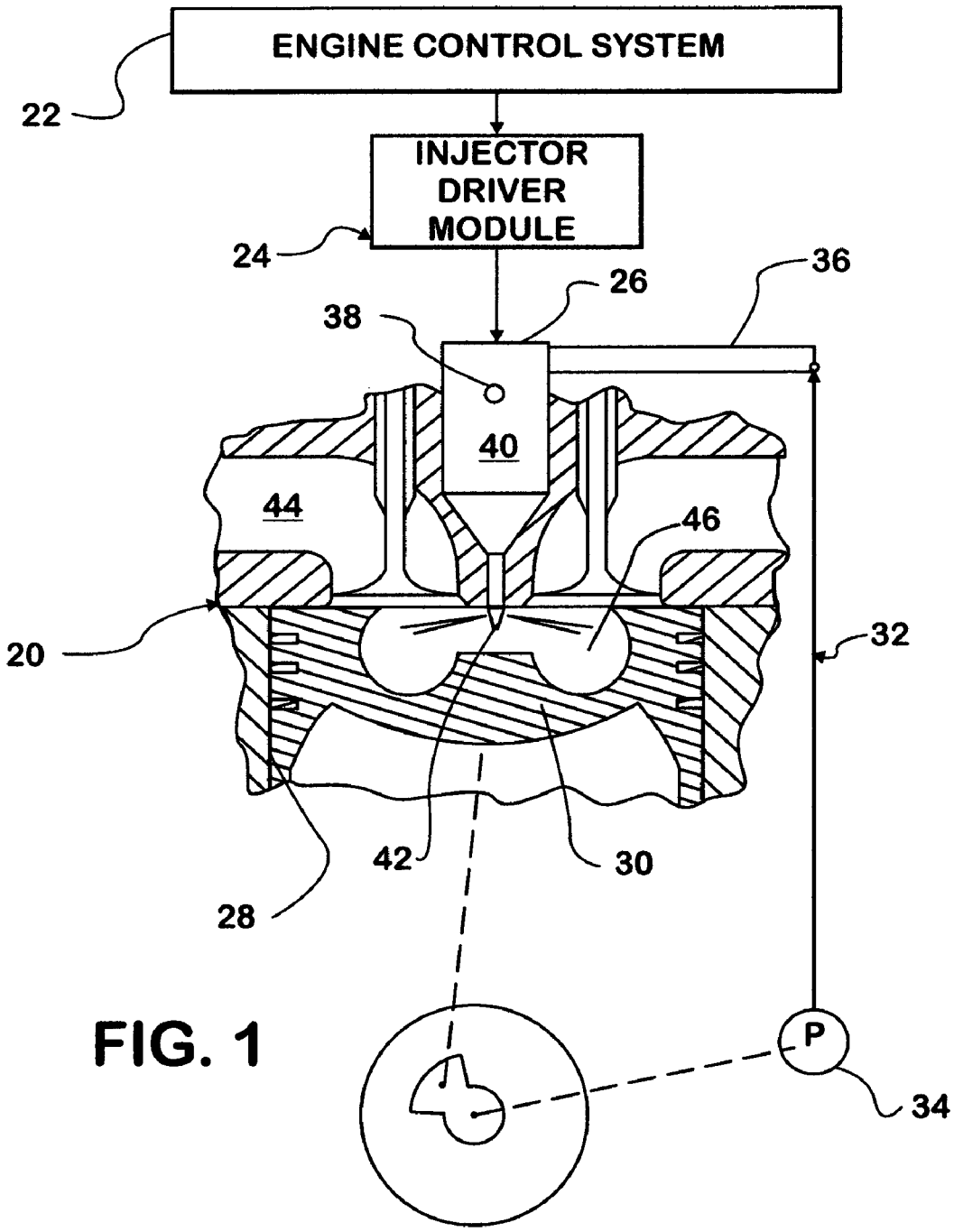
FIG. 1 is a general schematic diagram of a portion of an exemplary diesel engine relevant to an understanding of principles of the invention.

FIG. 1 shows a schematic representation of a portion of an exemplary compression ignition engine 20 useful as a point of reference for explaining principles of the present invention. Engine 20 is a mobile type diesel engine used to propel a motor vehicle.

Engine 20 has a processor-based engine control system 22 that processes data from various sources to develop various control data for controlling various aspects of engine operation. One control function performed by control system 22 is control of an injector driver module 24 for controlling the operation of electric-actuated fuel injectors 26, each mounted on the engine in association with a respective engine combustion chamber, as illustrated by an engine cylinder 28 within which a piston 30 reciprocates. A processor of engine control system 22 can process data sufficiently fast to calculate, in real time, the timing and duration of injector actuation to set both the timing and the duration of a fuel injection.

Engine 20 further comprises an oil system 32 having a pump 34 for delivering oil under pressure to an oil rail 36 that serves in effect as a manifold for supplying oil, as a control fluid, to the individual fuel injectors 26.

A fuel source (not shown) is communicated to a fuel inlet port 38 in a body 40 of each fuel injector 26. Each fuel injector 26 comprises a nozzle 42 disposed in the respective combustion chamber space cooperatively defined by cylinder 28 and piston 30. Fuel injector 26 serves to inject diesel fuel under pressure into the combustion chamber via orifices in nozzle 42.

The injected fuel mixes with compressed charge air and recirculated exhaust that previously entered through an intake system 44 and that were thereafter compressed by piston 30 during a compression upstroke that continually decreased the effective volume of the combustion chamber space as the piston approached TDC.

The inventive process relates to the method of mixing of the injected fuel with the compressed in-cylinder charge and the resulting combustion. Details of that process will be described later.

The pressure of oil in oil rail 36 (ICP) is developed by pump 34, and it is the pressure of that oil that is used to force fuel through the orifices in nozzle 42. However, the maximum ICP that a typical pump can develop is not sufficiently high for the inventive process. In order to enable the inventive process to be performed, fuel injector 26 is one that has certain capabilities, one of which is the capability for amplifying the oil pressure, such as by an internal intensifier piston. Some "digital" fuel injectors have the capability for applying selectable amplification factors to injected fuel, and while the capability of changing the amplification factor during progress of an injection of fuel is often useful for ROI shaping as a specific feature of the invention, that capability is not essential to more fundamental principles of the invention.

Fundamental to principles of the invention is the ability of fuel injector 26 to inject diesel fuel into the combustion chamber space at ultra-high injection pressure (meaning a pressure in excess of about 3,000 bar within a range extending to a pressure of about 4000 bar) through a sufficient number of tiny orifices in nozzle 42, orifices that are suitably sized and appropriately located, to create a high-velocity fuel jet emanating from each nozzle. Injection velocities leaving each orifice are preferably in excess of about 575 meters per second (m/s), and orifice diameter is preferably within a range of about 80 microns to about 130 microns.

Emanating at such velocities from such orifices, the fuel streams are forced to mix with the compressed charge mixture of air and recirculated exhaust throughout a substantial portion of the constantly changing effective volume of the combustion chamber space at a rate sufficiently faster than the kinetics of combustion of the mixture that is being created. The process creates distributed fuel/air mixtures throughout a substantial portion of the compressed charge in the combustion chamber space substantially at incipiency of the in-cylinder combustion event so that the ensuing combustion is that of a more homogeneous fuel/air mixture than one created by conventional diesel (CD) combustion processes.

FIG. 1 depicts piston 30 substantially at TDC. The timing of injection occurs over a range of crank angles beginning somewhat in advance of TDC, but not as far advanced as would be typical for HCCI combustion. Injection may end substantially at TDC just as peak compression is occurring. At rated power for an engine, injection duration occurs within a range of about 25 crank angle degrees to about 35 crank angle degrees.

Figure 2:
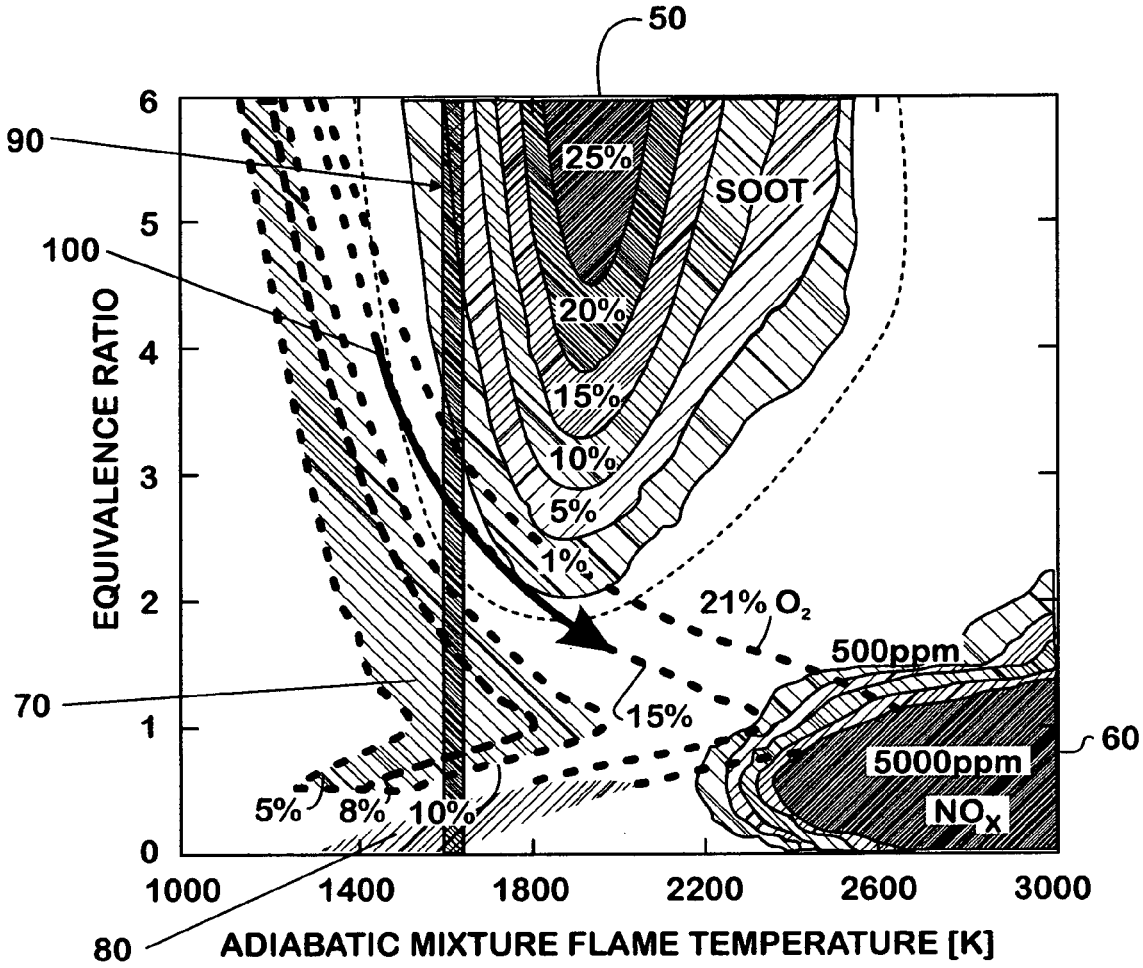
FIG. 2 is a graph plot of certain relationships useful in explaining principles of the present invention.

FIG. 2 presents a graphical portrayal of certain combustion process parameters useful in explaining the inventive process.

The horizontal axis of the graph represents adiabatic mixture flame temperature in degrees Kelvin (K), and the vertical axis represents equivalence ratio of fuel/air mixture. An equivalence ratio of 1 represents a stoichiometric mixture. Higher numbers represent richer mixtures, with the particular number representing a multiple of richness. For example, an equivalence ratio of 3 represents a mixture that is three times as rich as a mixture whose equivalence ratio is 1.

Published literature that describes investigation of diesel combustion processes has identified what are referred to as a "soot island" and a "NOx island" in graphical portrayals like the one shown here where a distinctive soot island 50 and a distinctive NOx island 60 can be seen. A portion of the perimeter of each island is bounded by a respective drop-off region where soot percentage and ppm (parts per million) NOx progressively diminish in directions away from the respective islands.

Soot island 50 is defined as a 25% soot zone, meaning that the products of the combustion process comprise 25% soot. FIG. 2 shows the soot island drop-off region to comprise a succession of zones marked 20%, 15%, 10%, 5%, and 1%.

NOx island 60 is defined by a 5000 ppm NOx zone, meaning that the products of the combustion process comprise 5000 parts per million NOx. The NOx island drop-off region comprises a succession of zones with only the outermost being marked 500 ppm.

The example of FIG. 2 shows that larger amounts of soot are created when the equivalence ratio is relatively higher (i.e. greater than about 2.5) with adiabatic mixture flame temperature in the range from about 1700° K to about 2300° K. At an equivalence ratio of less than about 2, soot generation is relatively small regardless of adiabatic mixture flame temperature.

FIG. 2 further shows that larger amounts of NOx are created when the equivalence ratio is low (i.e. less than about 1) but with the adiabatic mixture flame temperature quite high (above about 2300° K). Otherwise NOx generation becomes relatively low as adiabatic mixture flame temperature becomes less than about 2200° K regardless of equivalence ratio.

There is however a distinct zone of separation between the outermost zones of the respective drop-offs. Combustion processes that occur in that separation zone generate both relatively lower soot and relatively lower NOx.

Principles of the present invention contemplate initiating and continuing a combustion event with the objective that throughout the event, combustion on a microscopic scale throughout the combustion chamber space will occur in the separation zone so that on a macroscopic scale, the event can be considered also to occur in the separation zone. In that way, both soot and NOx formation can be significantly minimized within the combustion chamber space itself.

As a practical matter, it may not be possible for the totality of microscopic scale events to occur in that way, but through the method that is disclosed here, a substantial portion of all microscopic combustion events can occur in the separation zone. The dynamics of a running engine are of course constantly changing the effective volume of the combustion chamber space, but in the vicinity of TDC, the rate of change of that volume is relatively smaller than the rate of change both later in the expansion downstroke and earlier in the compression upstroke. With initiation of a combustion event substantially at TDC and much of the event occurring early in the ensuing downstroke, the change in effective volume of the combustion chamber space is relatively small enough to make FIG. 2 useful in defining the inventive process with reasonable accuracy.

FIG. 2 shows the oxygen content of the in-cylinder charge to also be a relevant parameter. The five lines shown relate various $O_2$ concentration percentages (5%, 8%, 10%, 15%, and 21%) to both equivalence ratio and adiabatic mixture flame temperature. The shaded area between the 5% and 10% lines (marked by reference numeral 70) represents CD combustion that results from the combined use of fuel injectors that inject fuel at relatively lower injection pressure and relatively lower injection velocities and of increased EGR that limits oxygen concentration and thereby slows the kinetics of the combustion process so that an acceptable mixing rate can be attained at lower pressure and velocity. Area 70 may be considered to represent low temperature CD combustion. But as discussed earlier, the use of low temperature CD combustion comes at the cost of increasing the complexity of the charge management system and increasing total system heat rejection. Furthermore, it is believed fair to state that to date exhaust after-treatment devices are still likely to be required for any large engine operating on low temperature CD combustion in order to comply with projected tailpipe emission requirements.

A zone marked by the reference numeral 80 in FIG. 2 represents HCCI combustion. While HCCI combustion may appear preferable to CD combustion on the basis of FIG. 2, the present state of engine technology is unable to support use of HCCI combustion at higher engine speeds and torques.

The line marked 90 is the temperature limit for useful flame propagation. If combustion is not complete before the local in-cylinder temperature and mixture composition cause the flame temperature to fall below (or not attain) this temperature limit, combustion would not be complete, and the hydrocarbon and carbon monoxide content of cylinder exhaust would increase.

Keeping the foregoing description in mind, the inventive process will now be related to FIG. 2.

An arrow marked 100 running along the 15% oxygen concentration line suggests how fuel injector 26 creates distributed air/fuel mixtures throughout a substantial portion of the effective combustion chamber space volume at incipiency of an in-cylinder combustion event. The injected fuel streams create high equivalence ratios immediately proximate the nozzle orifices upon exiting the orifices because they are essentially unmixed with the charge gas. This stage of the process corresponds to the portion of the 15% oxygen concentration line above the tail of arrow 100.

However because of their high velocities, the fuel streams move through the hot compressed gas charge in a manner that outraces the rate at which the fuel in the streams can combust. As they move, the streams displace compressed gas, adding to in-cylinder turbulence that promotes mixing and decreases the equivalence ratio along the travel of the streams. This stage may be considered to represent movement along arrow 100 toward the arrowhead.

The streams continue, quickly striking the surface of the piston bowl 46, only to rebound from a multitude of locations on that surface and creating further turbulence, dispersion, and mixing. As fuel streams through the effective volume of the combustion chamber space, rebound from surfaces bounding that space, and continue to disperse within that space, the fuel does begin to ignite. However, continued burning of the fuel occurs throughout a mixture that now has improved homogeneity due to the method of injection, especially when compared with conventional diesel (CD) combustion processes. This may be considered to correspond to combustion occurring in the zone of separation between the soot island and the NOx island, a zone in which all combustion should ideally occur in theory to minimize soot and NOx while achieving desired engine performance. In practice that cannot be the case because attainment of perfect homogeneity before the onset of any combustion is impossible to achieve as a practical matter with known technology.

Hence, the reader can appreciate that the description given in the preceding few paragraphs describes the inventive process as one in which fueling occurs in conjunction with diluent control in such a way that the aggregate combustion process, as a function of time, progresses along a path, such as indicated by arrow 100, to quickly skirt past the soot formation region via the outer zones of its drop-off and then continue to conclusion in the separation zone between the soot island and the NOx island. In that way, principles of the invention reduce both in-cylinder soot formation and in-cylinder NOx formation, with attendant potential benefits as discussed above.

While a presently preferred embodiment of the invention has been illustrated and described, it should be appreciated that principles of the invention apply to all embodiments falling within the scope of the following claims.

What is claimed is:

1. A fuel injector for injecting diesel fuel into a combustion chamber of a compression ignition engine comprising:

an intensifier for amplifying ICP to create an injection pressure at a nozzle of the fuel injector at least about 3000 bar;

and a multitude of orifices in the nozzle through which fuel is injected, the orifices having diameters within a range from about 80 microns to about 130 microns.

* * * * *